US012145702B2

(12) United States Patent
Laroche

(10) Patent No.: US 12,145,702 B2
(45) Date of Patent: Nov. 19, 2024

(54) DIVE MASK FOR UNDERWATER COMMUNICATION

(71) Applicant: Juliette Laroche, San Francisco, CA (US)

(72) Inventor: Juliette Laroche, San Francisco, CA (US)

( * ) Notice: Subject to any disclaimer, the term of this patent is extended or adjusted under 35 U.S.C. 154(b) by 0 days.

(21) Appl. No.: 17/935,820

(22) Filed: Sep. 27, 2022

(65) Prior Publication Data

US 2023/0094370 A1 Mar. 30, 2023

Related U.S. Application Data

(60) Provisional application No. 63/261,675, filed on Sep. 27, 2021.

(51) Int. Cl.

| | |
|---|---|
| ***H04B 11/00*** | (2006.01) |
| ***B63C 11/12*** | (2006.01) |
| ***B63C 11/26*** | (2006.01) |

(52) U.S. Cl.

CPC ..... *B63C 11/26* (2013.01); *B63C 11/12* (2013.01); *B63C 2011/123* (2013.01)

(58) Field of Classification Search

CPC ... B63C 11/26; B63C 11/12; B63C 2011/123; B63C 2011/121; G02B 27/0172; G02B 27/0176; G02B 2027/011; H04B 13/02; H04B 11/00

See application file for complete search history.

(56) References Cited

U.S. PATENT DOCUMENTS

| | | | | | |
|---|---|---|---|---|---|
| 2,333,336 | A * | 11/1943 | Powell | B63C 11/12 | 2/428 |
| 3,587,038 | A * | 6/1971 | Massa, Jr. | B06B 1/0655 | 367/910 |
| 4,081,209 | A * | 3/1978 | Heller | A42B 3/042 | 359/482 |
| 4,360,253 | A * | 11/1982 | Wyatt | G01R 13/40 | 351/158 |
| 4,563,758 | A * | 1/1986 | Paternostro | H04B 11/00 | 128/201.27 |
| 4,870,550 | A * | 9/1989 | Uke | F21V 15/01 | 362/202 |
| 5,136,555 | A * | 8/1992 | Gardos | B63C 11/26 | 367/901 |
| 5,191,317 | A * | 3/1993 | Toth | G08B 21/182 | 340/815.45 |
| 5,523,982 | A * | 6/1996 | Dale | H04B 11/00 | 367/134 |
| 5,767,932 | A * | 6/1998 | Gordon | B63C 11/12 | 351/158 |

(Continued)

*Primary Examiner* — Edwin J Toledo-Duran
(74) *Attorney, Agent, or Firm* — PRANGER LAW PC

(57) ABSTRACT

A dive mask including an ultrasonic communication system and an alert subsystem to measure the distance between two dive masks and alert divers if they have moved apart and exceeded a setpoint range. An illuminating edge or indicator light including at least one LED will illuminate to notify the divers they have moved apart and exceeded the setpoint range. The dive mask includes a danger function the divers may trigger to notify each other of potential danger. The dive mask includes a function to illuminate the at least one LED if the battery level in either dive mask is low.

23 Claims, 13 Drawing Sheets

(56) References Cited

U.S. PATENT DOCUMENTS 5,784,339 A * 7/1998 Woodsum ..... H04B 11/00 367/134
5,889,730 A * 3/1999 May ..... B63C 11/26 367/132
6,125,080 A * 9/2000 Sonnenschein ..... H04B 13/02 367/134
6,272,072 B1 * 8/2001 Wulich ..... G01S 3/8022 73/178 R
6,390,640 B1 * 5/2002 Wong ..... F21L 4/00 362/184
6,447,115 B1 * 9/2002 Gallagher ..... B63C 11/12 351/158
6,856,578 B2 * 2/2005 Magine ..... H04B 11/00 367/134
7,006,407 B2 * 2/2006 Davies ..... H04B 13/02 367/134
7,038,639 B1 * 5/2006 Olstad ..... B63C 11/12 345/8
8,082,922 B2 * 12/2011 McWilliams ..... G02B 27/017 128/201.23
8,094,518 B2 * 1/2012 Fleming ..... H04B 13/02 367/134
9,001,005 B2 * 4/2015 Abdollahi ..... G02B 27/0176 345/7
9,096,166 B2 * 8/2015 Ogusa ..... G08G 1/163
11,316,559 B2 * 4/2022 Ahola ..... H04B 5/79
2002/0176323 A1 * 11/2002 Magine ..... B63C 11/26 367/134
2003/0084500 A1 * 5/2003 Testa ..... B63C 11/12 2/431
2003/0115010 A1 * 6/2003 Estep ..... B63C 11/12 702/127
2003/0117369 A1 * 6/2003 Spitzer ..... G02F 1/13454 257/E29.295
2004/0130442 A1 * 7/2004 Breed ..... G06V 20/593 340/449
2008/0304362 A1 * 12/2008 Fleming ..... H04B 13/02 367/134
2010/0091612 A1 * 4/2010 Skrobanek ..... B63C 11/26 367/134
2012/0212398 A1 * 8/2012 Border ..... G06Q 30/02 345/8
2012/0212399 A1 * 8/2012 Border ..... G02B 27/0172 345/8
2013/0127980 A1 * 5/2013 Haddick ..... G06F 3/013 348/14.08
2013/0288596 A1 * 10/2013 Suzuki ..... H04B 11/00 455/40
2014/0177394 A1 * 6/2014 Fleming ..... H04B 11/00 367/131
2014/0287806 A1 * 9/2014 Balachandreswaran ..... A63F 13/285 463/7
2014/0361976 A1 * 12/2014 Osman ..... G02B 27/017 345/156
2015/0035440 A1 * 2/2015 Spero ..... F21S 41/147 315/153
2016/0025978 A1 * 1/2016 Mallinson ..... G02B 27/0172 345/8
2016/0042566 A1 * 2/2016 Mao ..... A63F 13/213 463/31
2016/0091720 A1 * 3/2016 Stafford ..... G02B 27/0172 345/8
2016/0096601 A1 * 4/2016 Hollis ..... B63C 11/12 713/1
2016/0189429 A1 * 6/2016 Mallinson ..... G02B 27/017 345/633
2016/0248994 A1 * 8/2016 Liu ..... A61B 5/7445
2016/0292924 A1 * 10/2016 Balachandreswaran ..... G02B 27/017
2017/0183068 A1 * 6/2017 Lindman ..... G01S 5/0226
2017/0361132 A1 * 12/2017 Dykes ..... G01C 21/166
2018/0343530 A1 * 11/2018 Klose ..... H04R 29/001
2019/0039702 A1 * 2/2019 Gamberini ..... B63C 11/26
2019/0392088 A1 * 12/2019 Duff ..... G02B 27/0172
2021/0200496 A1 * 7/2021 Torii ..... G02B 27/0172
2021/0229786 A1 * 7/2021 Marcellin-Dibon ..... G02B 27/0172
2022/0014224 A1 * 1/2022 Schmidt ..... G02B 27/017
2022/0236798 A1 * 7/2022 Kimura ..... G06F 3/013
2022/0255995 A1 * 8/2022 Berliner ..... G06T 15/20
2023/0007085 A1 * 1/2023 Berliner ..... G06F 3/04815
2023/0094370 A1 * 3/2023 Laroche ..... B63C 11/26 405/186
2023/0122713 A1 * 4/2023 Macia ..... A61B 8/4236 600/301

* cited by examiner

DIVE MASK FOR UNDERWATER COMMUNICATION

TECHNICAL FIELD

The present disclosure relates generally to underwater communication, and more particularly to a dive mask that utilizes ultrasonic communication, as well as components of such dive masks or systems and methods, that implement the benefits described herein.

BACKGROUND

Recreational underwater diving is becoming more popular as people wish to experience the beauty of oceans. For an inexperienced diver, there are many risks that can threaten the safety of divers. Some common risks include ocean life such as sharks or stingrays, depleted oxygen supply, regulator malfunctioning, faulty diving equipment, and divers drifting too far from a boat or group of other divers.

Conventional solutions for underwater communication range from rudimentary and inexpensive to complex and costly. Some divers, particularly recreational divers, rely on hand signals or whiteboards to communicate with other divers. These methods require both divers to be looking towards one another, and these methods can easily fail if either diver forgets what specific hand signals mean or a diver drops the whiteboard or marker. Another common approach used by divers is to tap their oxygen tanks with a metal object like a dive knife. This method requires a diver to carry a metal object capable of generating a noise that can be heard underwater by other divers, however, this may be risky as generating loud noises underwater can attract animals that may perceive the divers as a threat.

More complex communication options exist, but many are very expensive and not practical for the recreational diver. Underwater transceiver units may allow divers to communicate to some degree underwater, though most are very costly and take extensive knowledge and experience to use proficiently.

Accordingly, communicating while underwater can be risky and ineffective for the recreational diver.

SUMMARY

An embodiment of the present disclosure provides a dive mask comprising a mask body housing a lens; at least one light-emitting diode (LED) arranged on the mask body and adjacent the lens, an ultrasonic communication system configured to communicate with the at least one LED to selectively illuminate the at least one LED; a manipulatable knob usable to define a setpoint range; and an alert subsystem comprising an emitter configured to emit a first signal indicating the location of the dive mask, a sensor configured to sense a second signal indicating the location of a second dive mask, a processor electronically coupled to the LED and the ultrasonic communication system, the processor configured to measure a distance between the dive mask and the second dive mask, compare the distance to the setpoint range, and relay the distance to the ultrasonic communication system, and activate the at least one LED based upon a signal received from the ultrasonic communication system; and a setpoint range defined by a knob and operably coupled to the processor and ultrasonic communication system, wherein the setpoint range can be selected.

The summary above is not intended to describe each illustrated embodiment or every implementation of the present disclosure. The figures and the detailed description that follow more particularly exemplify these embodiments.

BRIEF DESCRIPTION OF THE DRAWINGS

The disclosure can be more completely understood in consideration of the following detailed description of various embodiments of the disclosure, in connection with the accompanying drawings, in which.

Figure 1:
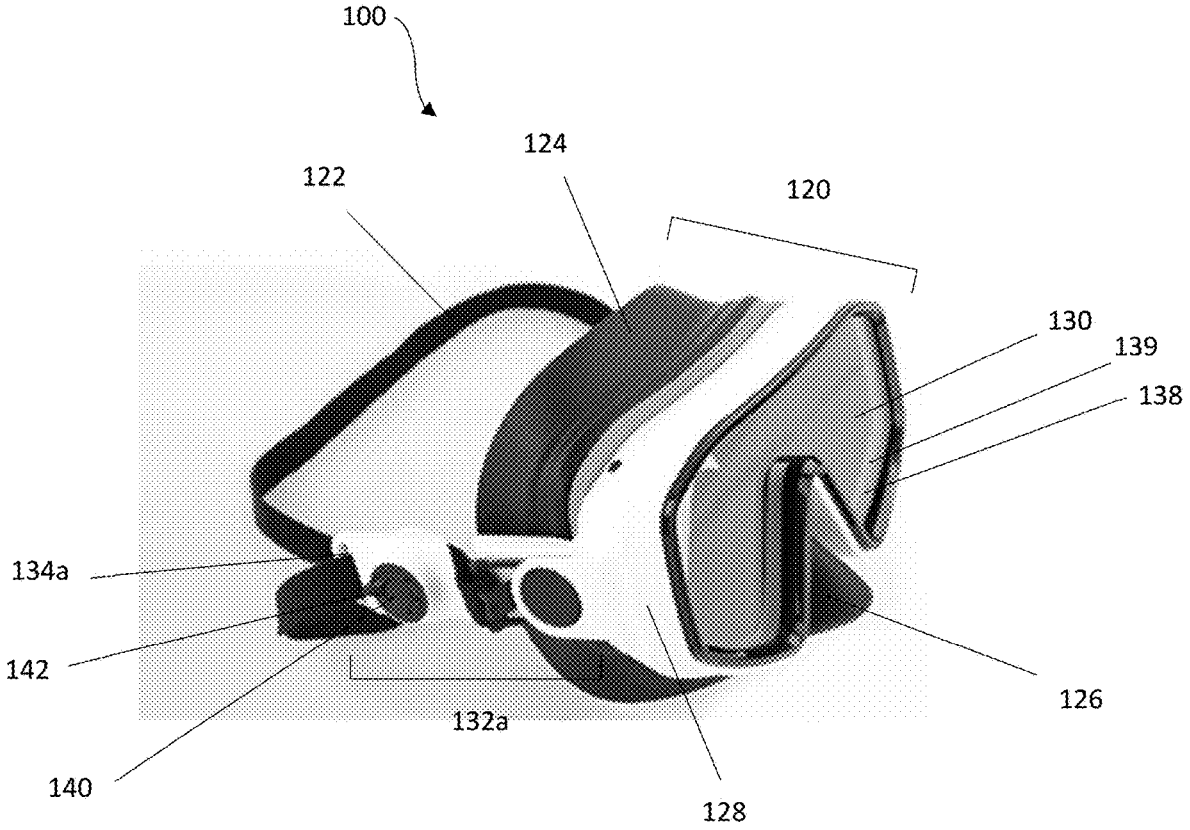
FIG. 1 is a top perspective view depicting a dive mask, in accordance with an embodiment of the disclosure.

While embodiments of the disclosure are amenable to various modifications and alternative forms, specifics thereof shown by way of example in the drawings will be described in detail. It should be understood, however, that the intention is not to limit the disclosure to the particular embodiments described. On the contrary, the intention is to cover all modifications, equivalents, and alternatives falling within the spirit and scope of the subject matter as defined by the claims.

DETAILED DESCRIPTION

Referring to FIG. 1, dive mask 100 for underwater communication is depicted in accordance with an embodiment of the disclosure. Dive mask 100 may be used for scuba diving, snorkeling, or other underwater activities. Dive mask 100 may be in wired or wireless communication with other devices or systems, such as a mobile application, computer, tablet, smartphone or smart device, website, or other dive mask, such as via USB, USB-C, other wired communication formats and technologies, Bluetooth, Zigbee, WI-FI, or the like.

Figure 2:
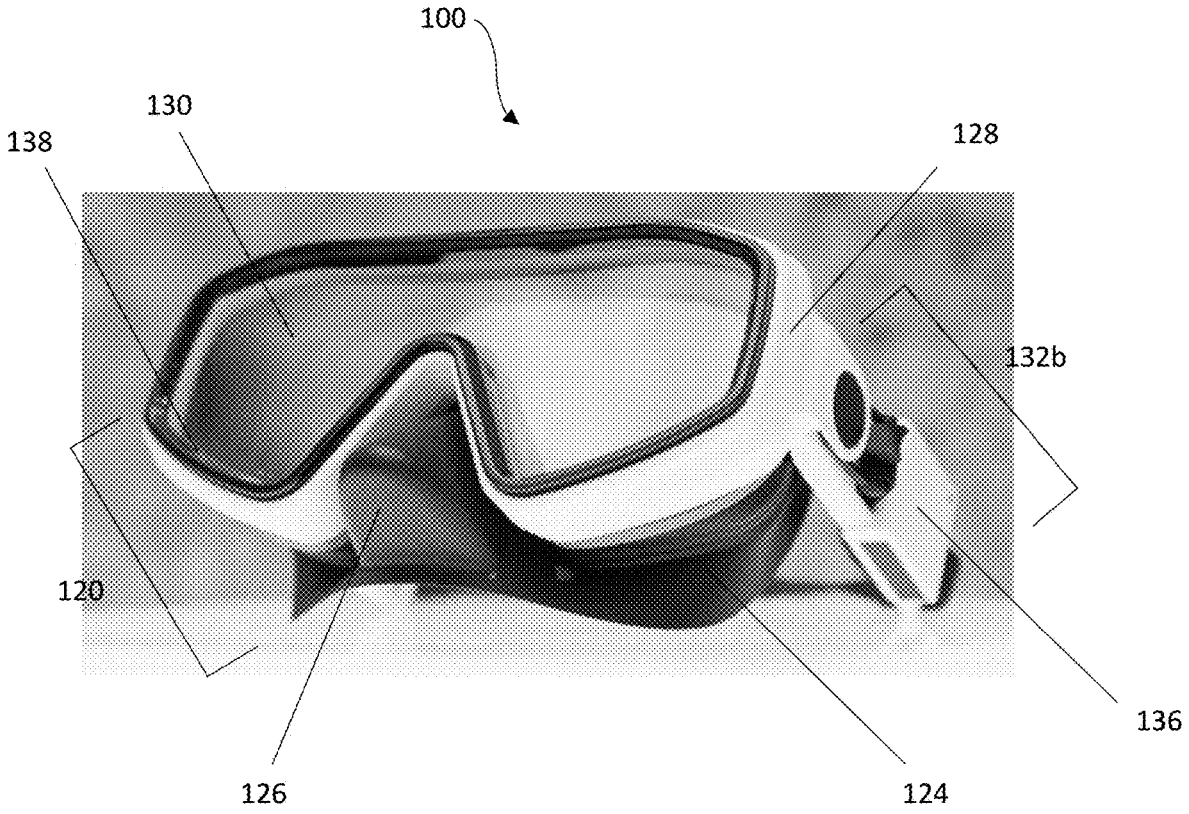
FIG. 2 is a bottom perspective view of the dive mask of FIG. 1.
Figure 3:
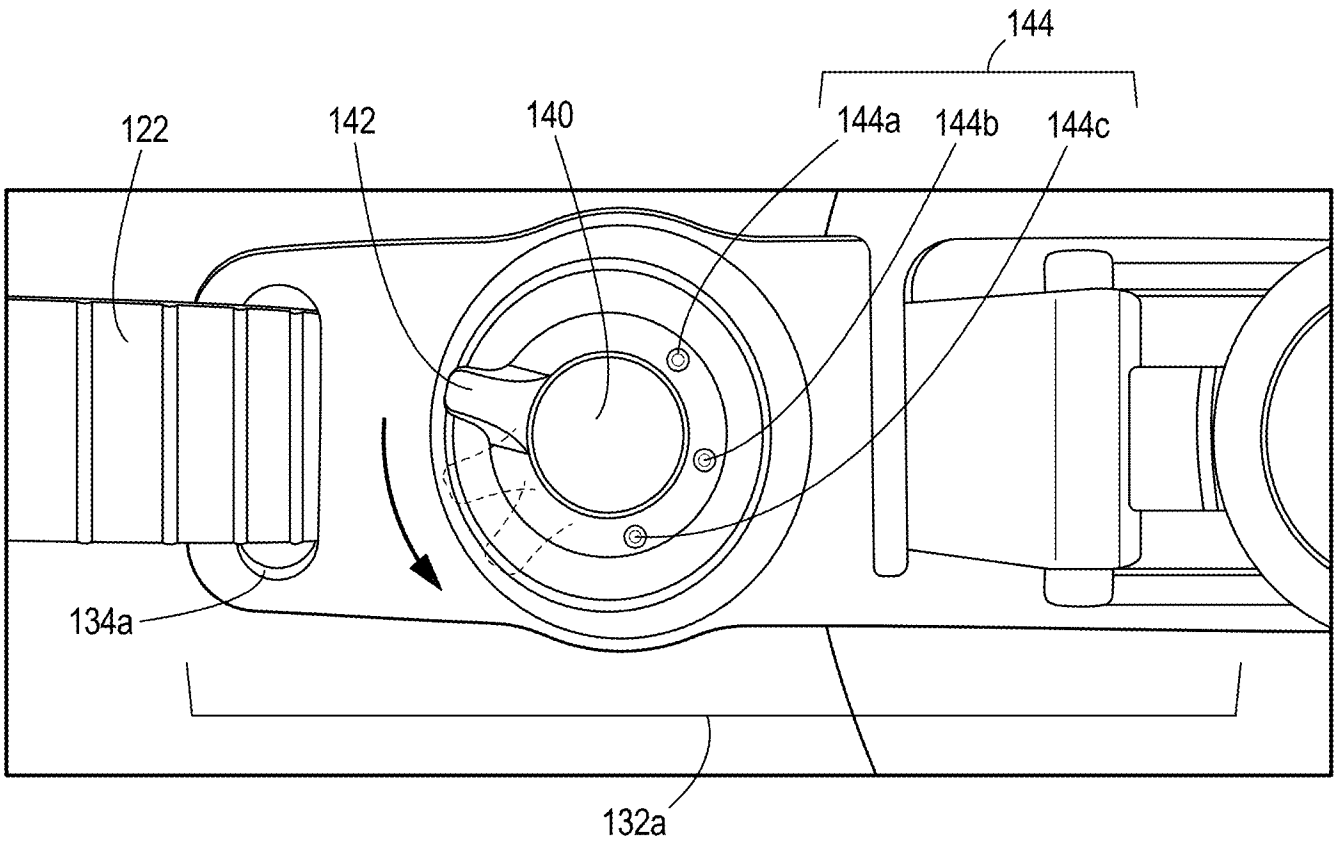
FIG. 3 is a detailed view of the left side view of the dive mask of FIG. 1.
Figure 9:
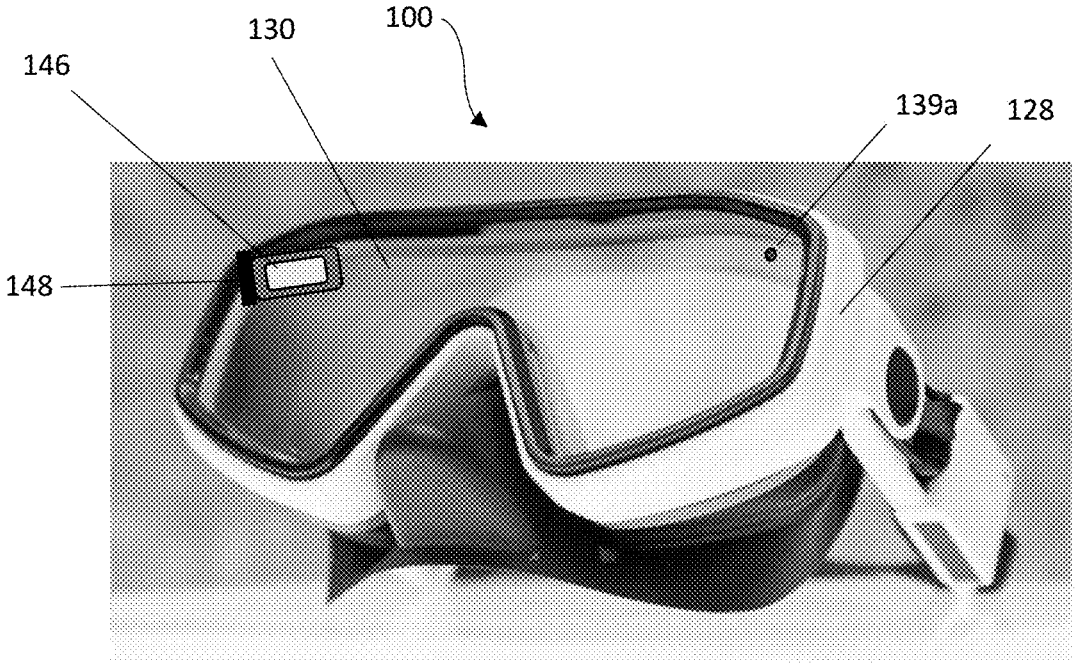
FIG. 9 is a bottom perspective view of a dive mask with a flashlight, in accordance with an embodiment of the disclosure.

In some embodiments, dive mask 100 includes a mask body 120 and a strap 122, the mask body 120 comprising a skirt 124, a nose piece 126, a frame 128, a lens 130, an illuminating edge 138, and arms 132*a* and 132*b* (as shown in FIGS. 1, 2, and 3). The illuminating edge 138 may contain at least one light-emitting diode (LED) 139 and may form a border around the edge of mask body 120. In some embodiments, the illuminating edge 138 may be disposed on other locations on the mask body 120 or could be a light source configured to project illumination onto those components, as a heads-up display. In some embodiments, the illuminating edge 138 may extend fully around lens 130 or may extend only along a portion of lens 130. Other positions of the at least one LED 139 are contemplated, such as on the lens 130 or the frame 128. In some embodiments, the at least one LED 139 may be an indicator light 139*a* placed on the inside or outside surface of lens 130 or the frame 128 in view of the diver, as shown in FIG. 9. The indicator light 139*a* may be placed in any configuration, such as in the top left or right corners of the lens 130 or the frame 128, or in the bottom left or right corners of the lens 130 or the frame 128. In some embodiments, the indicator light 139*a* may be covered with plastic or glass that is frosted or otherwise translucent to dim the indicator light 139*a*.

In some embodiments, dive mask 100 may include a flashlight 146. Flashlight 146 may be located in any suitable location on dive mask 100, such as embedded in the frame 128 or lens 130. FIG. 9 shows flashlight 146 embedded in the upper left corner of dive mask 100, but flashlight 146 may be disposed on any part of dive mask 100. Flashlight 146 may be activated using button 148 that is in electronic communication with processor 156 (shown in FIG. 7) and is electrically coupled to battery 136 to provide power. In embodiments, flashlight 146 may include multiple brightness and color hue settings that may be selected using button 148 or a mobile application or website. In some embodiments, flashlight 146 may be a separate device configured to be attached to dive mask 100. Flashlight 146 may be clipped or snapped onto the frame 128 or the lens 130, or attached using other suitable mechanisms.

Arms 132*a* and 132*b* may include apertures 134*a* and 134*b* (shown in FIGS. 1, 2, and 3) to attach strap 122 to the mask body 120 in one embodiment. In other embodiments, arms 132*a* and 132*b* can be formed as a unitary structure with strap 122. In some embodiments, dive mask 100 may not include apertures 134*a* and 134*b* and may use a stretchable strap 122, snaps, buttons, latches or other closure mechanisms. Arm 132*a* includes a button 140 and a manipulatable knob 142 configured to communicate with an alert subsystem 150 and an ultrasonic communication system 160 (shown in FIG. 7). In some embodiments, button 140 and knob 142 are disposed in other locations on dive mask 100 such as mask body 120, skirt 124, frame 128, illuminating edge 138, lens 130, and arm 132*b*.

Figure 4:
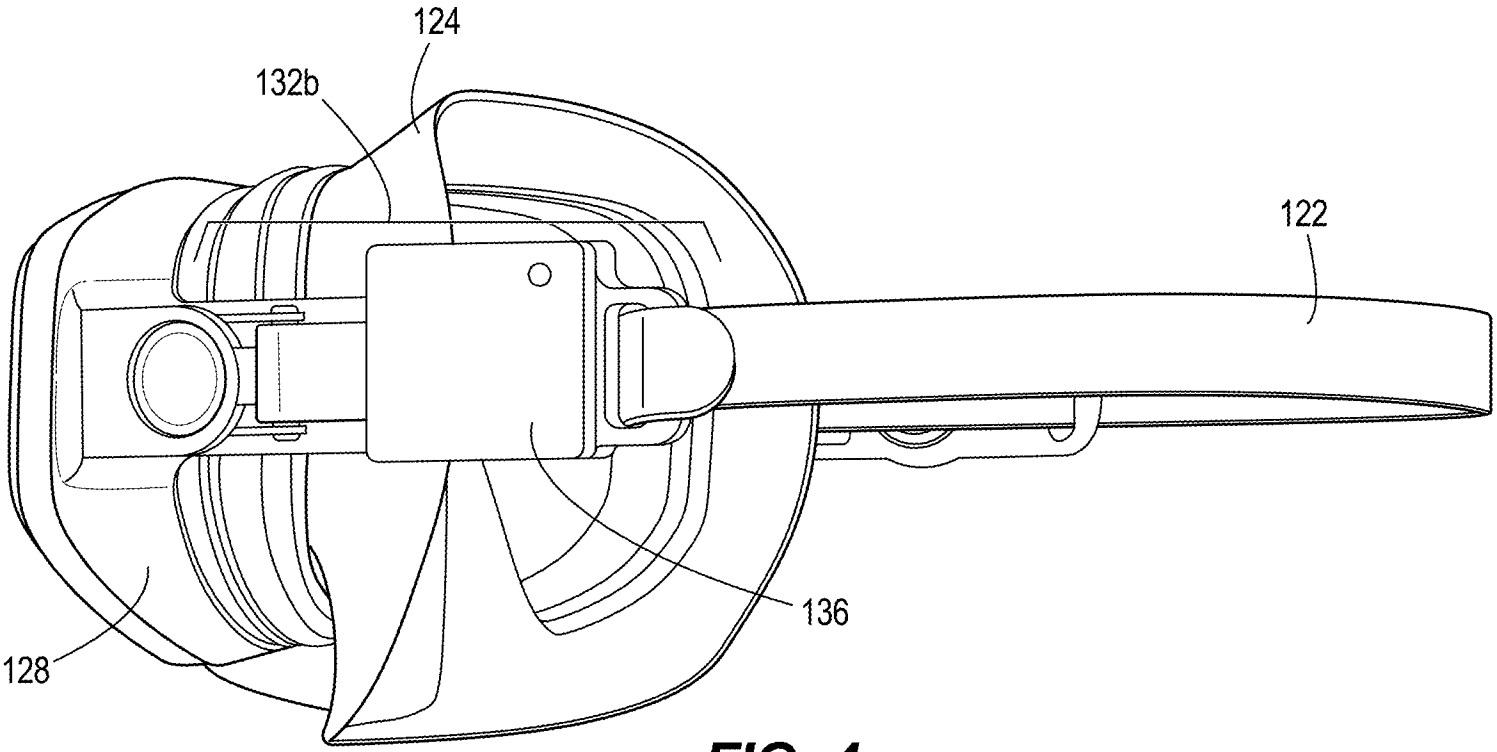
FIG. 4 is a detailed view of the right side view of the dive mask of FIG. 1.

With additional reference to FIGS. 2 and 4, arm 132*b* may include battery 136. Battery 136 may be any conventional battery type such as lithium-ion, nickel cadmium, or nickel metal hydride. Battery 136 may also be rechargeable or non-rechargeable. In some embodiments, battery 136 is positioned elsewhere on dive mask 100 such as on mask body 120, strap 122, skirt 124, arms 132*a* and 132*b*, or frame 128.

In some embodiments, battery 136 may be removable for recharging, or battery 136 may be a single use battery configured to be replaced. In other embodiments, battery 136 is embedded in dive mask 100 in a watertight packaging. Battery 136 may be charged using wireless charging technology, such as with a docking station, holder, pad, or carrying case (shown in FIGS. 11A and 11B and described in more detail below) configured to have wireless charging capabilities. In some embodiments, battery 136 may be charged using a USB, USB-C, or other suitable charging cord. Battery 136 may include a charging port (not shown) with a watertight seal and plug to connect a charging cord to a power source.

With additional reference to FIG. 3, arm 132*a* is shown in more detail, depicting the button 140 and knob 142. In some embodiments, button 140 may have multiple functions. For example, button 140 may activate an activation element with one press (described with reference to FIG. 8), and button 140 may activate a notification function with two presses. The notification function may illuminate the at least one LED 139 in the illuminating edge 138 of dive mask 100 to get the attention of a diving partner for a non-danger scenario, such as to point out a sight underwater. In some embodiments, the speed of multiple button 140 presses may activate other functions. For example, two fast button 140 presses may illuminate a yellow LED to indicate to a diving partner to slow down, and two slow button 140 presses may illuminate a purple LED to get the attention of a diving partner. Other combinations of button 140 presses, speed of button 140 presses, and colors of LEDs are contemplated. In an embodiment, dive mask 100 is turned on by pressing and holding button 140 for several seconds. The at least one LED 139 will illuminate the illuminating edge 138 and blink twice to indicate to a diver that dive mask 100 is on. In other embodiments, the at least one LED 139 may illuminate or blink in a different pattern to indicate dive mask 100 is on.

Also located on arm 132*a* is knob 142, which corresponds to three settings 144: low setting 144*a*, medium setting 144*b*, and high setting 144*c*. The three settings 144 may correspond to different features of dive 100 mask in various embodiments. In one embodiment, the three settings correspond to setpoint ranges 170 (shown in FIG. 7) that indicate how far apart the divers may swim. Low setting 144*a* may correspond to a smaller range, medium setting 144*b* may correspond to a middle range, and high setting 144*c* may correspond to a larger range. A diver may toggle between settings 144 using knob 142, as shown by the counterclockwise arrow in FIG. 3. In some embodiments, dive mask 100 may include fewer or greater than three settings 144.

In embodiments, the settings 144 can be continuous or analog along a range. Furthermore, to prevent modifying the settings 144 defined by knob 142, knob 142 can be locked in some embodiments. The lock of knob 142 can be provided by pushing knob 142 in, pulling knob 142 out, or by engaging a mechanical rotation lock. In some embodiments, knob 142 may have a cover that may be selectively attached to and removed from dive mask 100 for adjustment of knob 142. In some embodiments, knob 142 may be replaced with a series of buttons, switches, or other suitable arrangement for modifying settings 144.

When diving in groups, it is advantageous for divers to remain in proximity to prevent one or more divers from moving too far away from a diving partner and becoming lost. The desired range between divers may be influenced by a variety of factors. For example, in murky waters where visibility is low, divers may want to remain closer together to prevent losing sight of their diving partner(s). Conversely, in clear waters with optimal visibility, divers may be comfortable swimming farther apart from each other. Alternatively, inexperienced divers, or divers in a tour group setting, may wish to remain closer together, while more experienced divers may be more comfortable swimming farther apart from one another.

In an embodiment, the setpoint ranges 170 may be pre-programmed by the manufacturer of dive mask 100. For example, low setting 144*a* may be pre-programmed to a setpoint range of 3 feet, medium setting 144*b* may be pre-programmed to a setpoint range of 10 feet, and high setting 144*c* may be pre-programmed to a setpoint range of 20 feet. Other setpoint ranges are contemplated from 1.5-30 feet, depending on diving conditions and user preference.

In another embodiment, the setpoint ranges 170 may be programmed by an individual user. A user may select desired setpoint ranges 170 corresponding to low setting 144*a*, medium setting 144*b*, and high setting 144*c* using a mobile application or website associated with dive mask 100.

Figure 5:
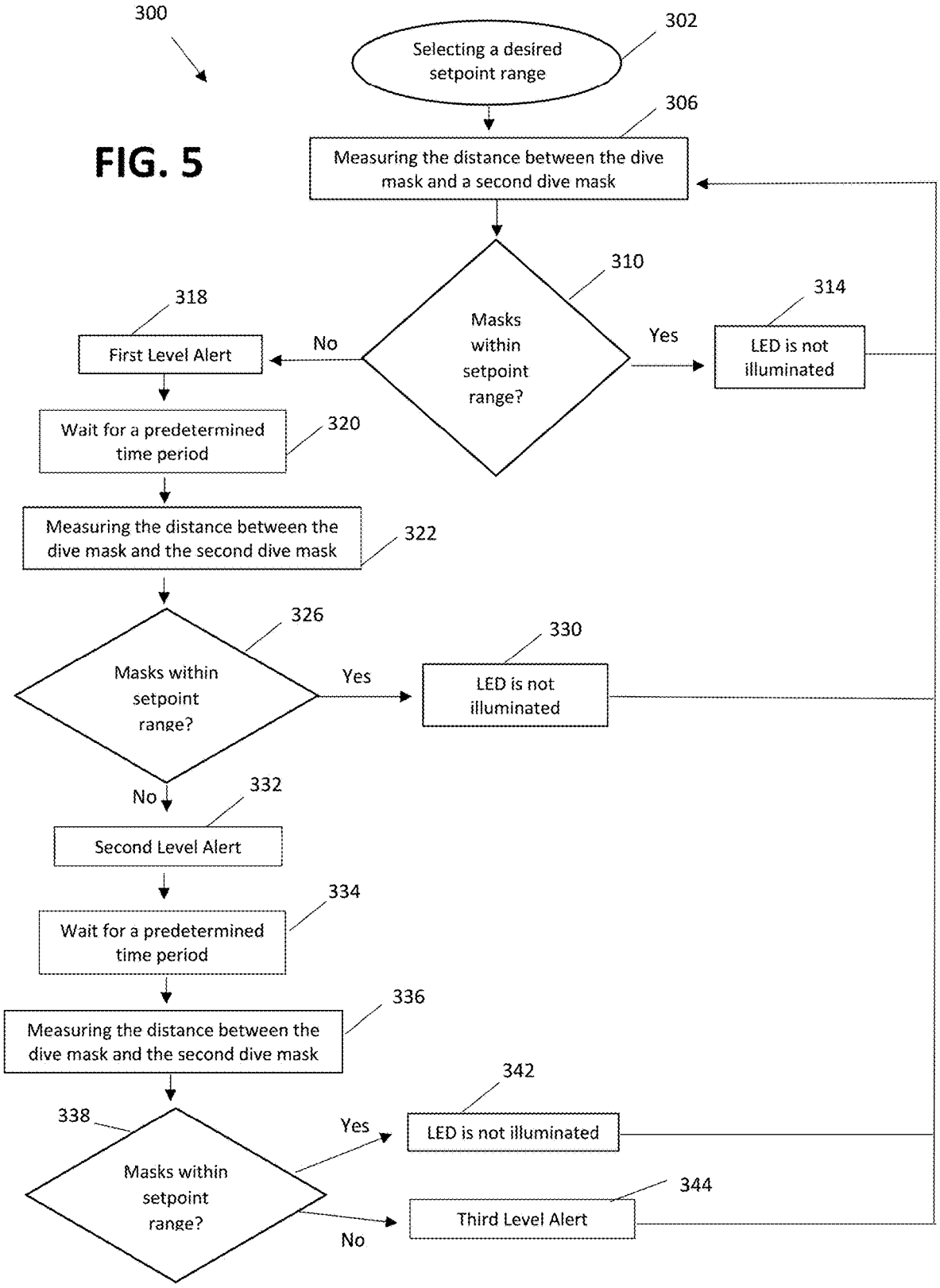
FIG. 5 is a flowchart illustrating an alert function of the dive mask of FIG. 1, in accordance with an embodiment of the disclosure.
Figure 6A:
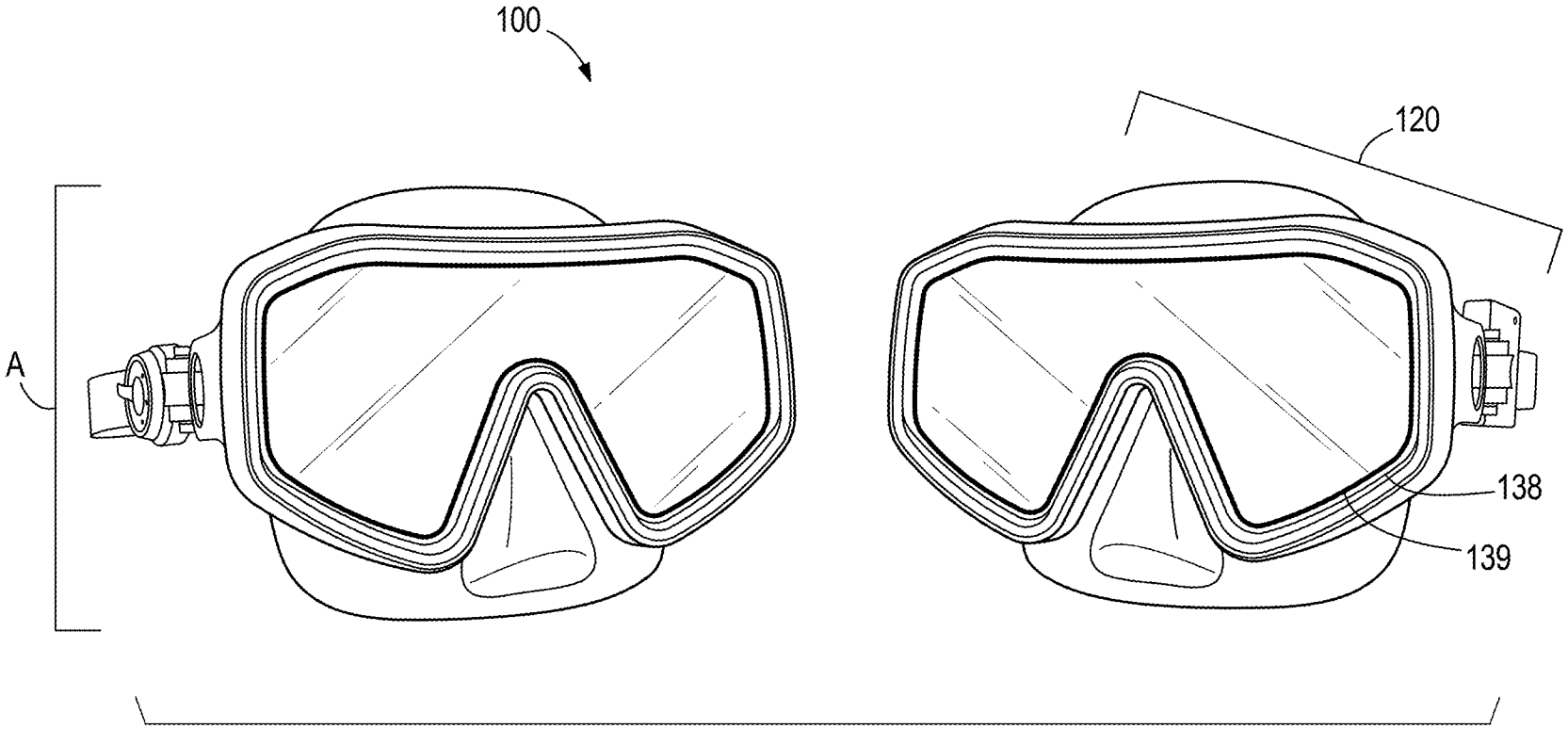
FIG. 6A is a diagram of two communicatively coupled dive masks of FIG. 1, illustrating an alert function of the dive mask, in accordance with an embodiment of the disclosure.
Figure 6B:
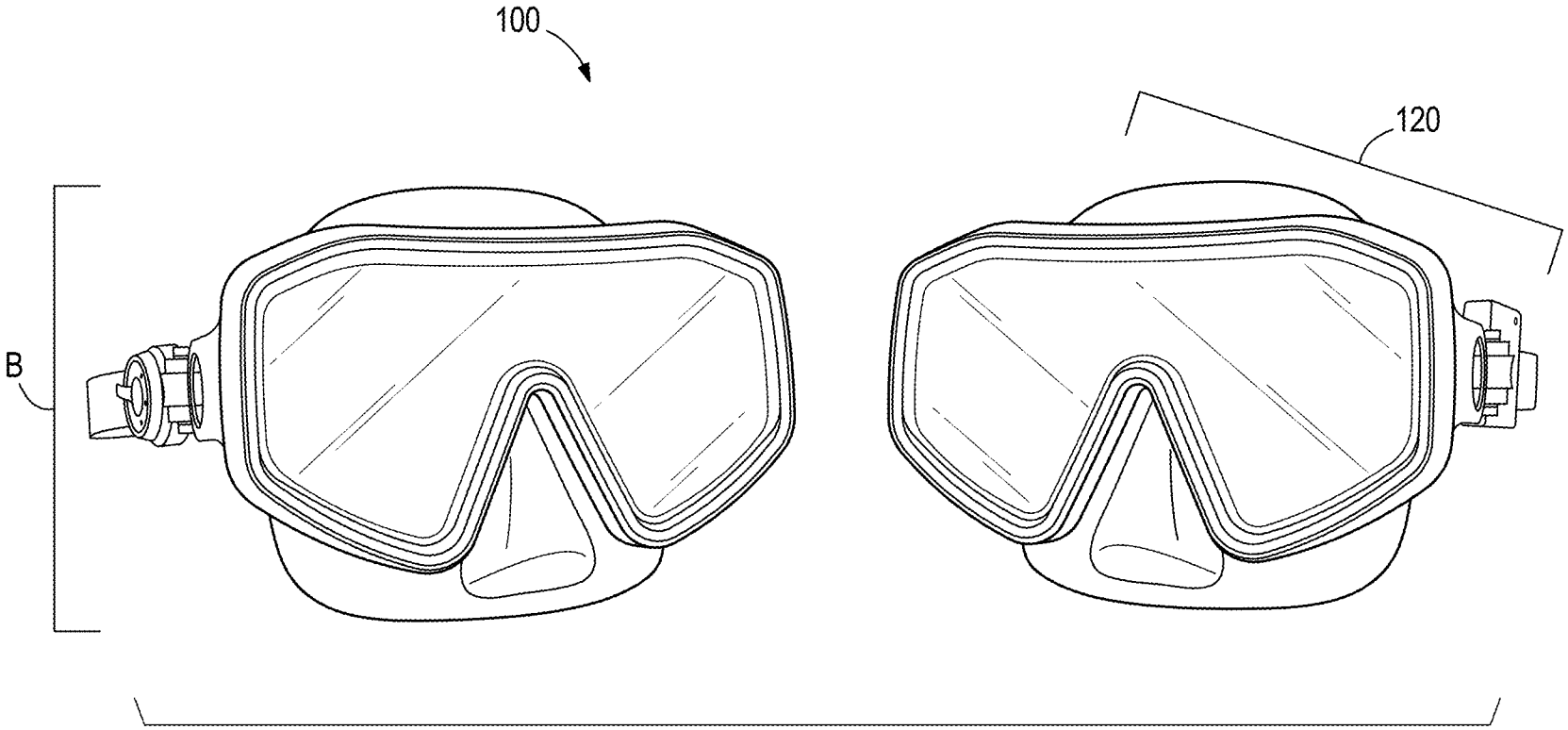
FIG. 6B is a diagram two communicatively coupled dive masks of FIG. 1, illustrating an alert function of the dive mask, in accordance with an embodiment of the disclosure.
Figure 7:
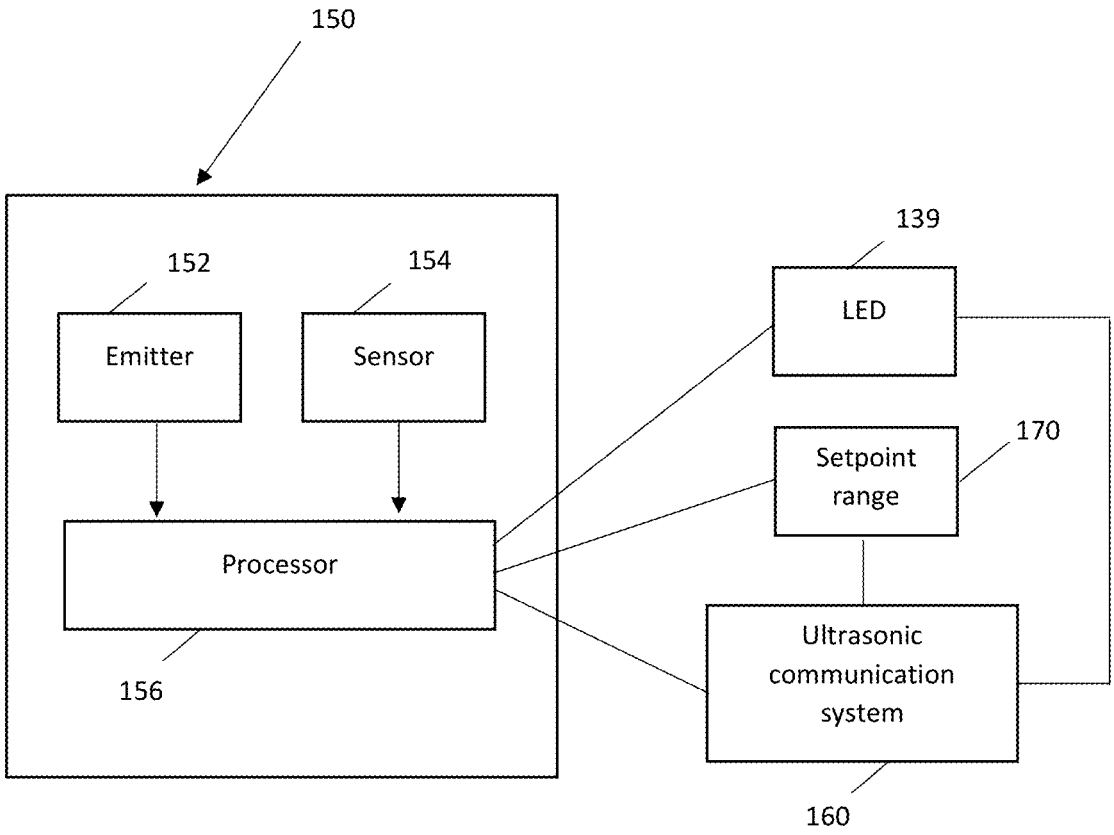
FIG. 7 is a block diagram of the electronics of the dive mask of FIG. 1, in accordance with an embodiment of the disclosure.

With additional reference to FIGS. 5, 6, and 7, a distance alert function of dive mask 100 is shown in flowchart 300 of FIG. 5. Two or more divers may prepare for underwater diving, each diver having a dive mask 100 communicatively coupled. Prior to diving, the divers may select a desired setpoint range 302 to indicate how far apart the divers may swim before the communicatively coupled dive masks 100 alert the divers they have exceeded the setpoint range 170. Once the divers begin underwater diving, an alert subsystem 150 will periodically measure the distance between a dive mask and a second dive mask 306. An emitter 152 in the alert subsystem 150 in dive mask 100 will emit a signal indicating the location of dive mask 100, and a sensor 154 in the alert subsystem 150 in the second dive mask 100 will sense that signal. A processor 156 in alert subsystem 150 may process the sensed signal emitted from a second dive mask 100 and the location of dive mask 100 and calculate a distance between the dive mask 100 and the second dive mask 100.

The processor 156 in alert subsystem 150 is communicatively coupled to the ultrasonic communication system 170. Ultrasonic communication system 170 uses a time of flight system. In such system, dive mask 100 and second dive mask 100 will periodically send ultrasonic waves toward each other. Once the dive mask 100 receives the ultrasonic wave sent by the second dive mask 100, and vice versa, the processor 156 in each dive mask will measure the distance traveled by the ultrasonic wave and the time for the wave to travel between the two dive masks 100. In some embodiments, the periodic intervals may be pre-programmed by the manufacturer of dive mask 100. In other embodiments, the periodic intervals may be selected by a user using a mobile application or website associated with dive mask 100. For example, the dive mask 100 may come pre-programmed with the ultrasonic waves to be sent back and forth every 10 seconds, and an inexperienced diver may wish to change the interval to every 5 seconds to ensure they remain close to their diving partner.

The processor 156 may compare the measured distance to the setpoint range 170 and determine if the masks are within the setpoint range 310. If the masks are within the setpoint range 170, the at least one LED 139 is not illuminated 314. If the masks are not within setpoint range 170, meaning the divers have moved farther apart than the distance selected for the setpoint range 170, a first level alert is triggered 318. For example, a first level alert may illuminate the at least one LED 139 in each of the communicatively coupled dive masks 100. When the at least one LED 139 is illuminated, the illuminating edge 138 will be visible to each diver in the periphery of each dive mask 100. Once the at least one LED 139 illuminates the illuminating edge 138, each diver may see the illuminated edge 138 on their dive mask 100 around the lens 130, signaling to the divers they should move closer together to stay within the setpoint range 170. In embodiments, the at least one LED 139 is in the indicator light 139*a* instead of or in addition to the illuminating edge 138.

After the first level alert is triggered 318, the alert subsystem will wait a predetermined period of time 320 to allow the divers to move within the setpoint range. The predetermined period of time may be pre-programmed by the manufacturer of dive mask 100 or may be selected by divers. In some embodiments, the pre-determined period of time may be 15 seconds, 30 seconds, or 60 seconds. Once the predetermined period of time has elapsed, the alert subsystem 150 will measure the distance between the dive mask 100 and the second dive mask 100 at periodic intervals 322. Once the alert subsystem 150 measures the distance between the dive mask 100 and the second dive mask 100, the processor 156 will determine if the divers are within the setpoint range 326. If the divers have moved within the setpoint range 170, the at least one LED 139 is no longer illuminated 330. If the divers have not moved within the setpoint range 170, a second level alert is triggered 332. The second level alert may involve an extra feature to alert the divers they are still outside the setpoint range. For example, the second level alert may cause the at least one LED 139 that is illuminated to pulse on both masks to warn the divers they have remained beyond the setpoint range 170 for a period of time.

The cycle will repeat again with the alert subsystem 150 waiting a predetermined period of time 334, the alert subsystem 150 measuring the distance between the masks 336, and determining if the masks are within the setpoint range 338. If the divers have moved within the setpoint range 170, the at least one LED 139 is no longer illuminated 342. If the divers remain outside the setpoint range 170, a third level alert is triggered 344. For example, a third level alert may include the at least one LED 139 pulsing more rapidly until the divers move closer until they are within the setpoint range 170. The first, second, and third level alerts may include any combination of illumination or pulsing of the at least one LED 139, including pulsing frequency and color-changing. In some embodiments, the first, second, and third level alerts may also include haptic or auditory signals.

The alert subsystem 150 will repeat this cycle for the duration of the underwater diving at periodic intervals. The periodic intervals may range from every 60 seconds to every 10 minutes. In some embodiments, the periodic intervals may be pre-programmed by the manufacturer of dive mask 100. In other embodiments, the periodic intervals may be selected by a user using a mobile application or website associated with dive mask 100.

FIGS. 6A-6B demonstrate the distance alert function of dive mask 100. FIG. 6A depicts a dive mask 100 and a second dive mask 100 that have moved farther apart than the setpoint range 170. The at least one LED 139 housed within illuminating edge 138 is illuminated in both dive masks. When the dive masks move closer together and are within the setpoint range 170, as shown in FIG. 6B, the at least one LED 139 will no longer be illuminated.

In some embodiments, the alert subsystem 150 may include different colors of the at least one LED 139 that may correspond to different functions. For example, the dive mask 100 in FIG. 6A shows illuminating edge 138 as blue, however, the at least one LED may be any suitable color and may include multiple LEDs of different colors.

In some embodiments, if the divers remain outside of the setpoint range 170 for multiple cycles of measuring the distance between the dive mask 100 and a second dive mask 100, the at least one LED 139 may pulse at varying intervals. For example, if the divers remain outside of the setpoint range 170 for 1 minute, the at least one LED 139 may pulse every 3 seconds. If the divers remain outside of the setpoint range 170 for 2 minutes, the at least on LED 139 may pulse every 2 seconds. If the divers remain outside of the setpoint range 170 for 3 minutes, the at least one LED 139 may pulse every half second. Other combinations of intervals are contemplated, such as pulsing more or less frequently, or at shorter intervals.

Figure 8:
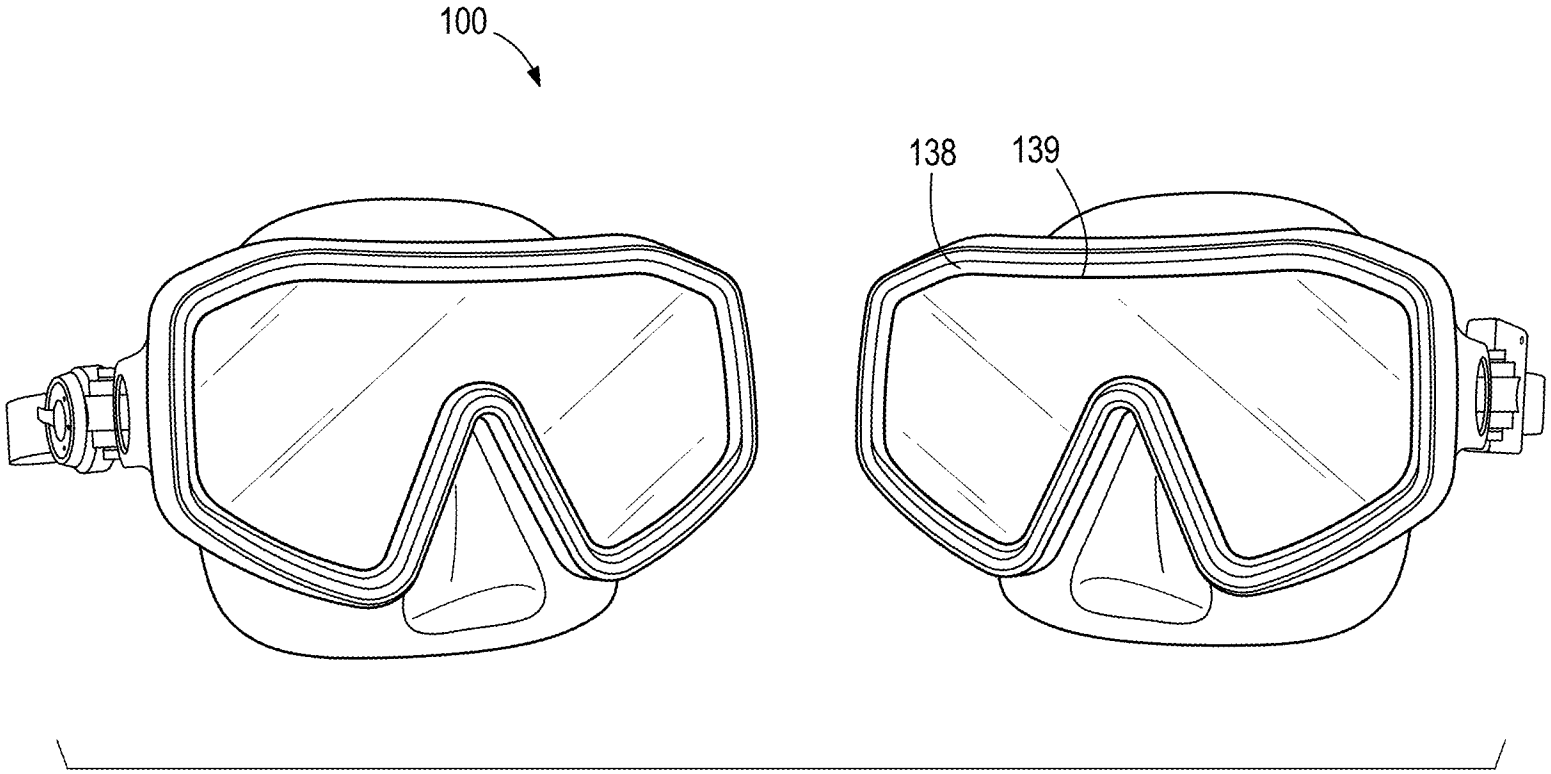
FIG. 8 is a diagram illustrating an activation element of the dive mask of FIG. 1, in accordance with an embodiment of the disclosure.

Referring to FIG. 8, dive mask 100 may include an activation element. Sometimes a diver may encounter danger while underwater diving, such as malfunctioning dive equipment or ocean life like a shark, or may experience distress. In such situations, a diver may want to notify their diving partner(s) of the danger or distress. A diver may press button 140 on dive mask 100 (shown in FIGS. 1 and 3), which will illuminate the at least one LED 139 in illuminating edge 138 of indication light 139*a* on the dive mask 100 and the second dive mask 100. Both the diver who initiated the activation element and the diving partner may see the illuminated at least one LED 139 in the periphery of the lens 130. In some embodiments, the at least one LED 139 is red and may pulse at regular intervals to indicate danger. A diver may turn off the activation element by pressing button 140 again, and the at least one LED 139 will no longer be illuminated.

In one embodiment, button 140 may activate the activation element with one press. In some situations, a diver may suddenly experience danger and need to alert their diving partner(s) immediately. Pressing button 140 once may quickly alert other divers to a dangerous situation without requiring a complicated series of steps that may be easily forgotten. In some embodiments, dive mask 100 may be communicatively coupled to other dive masks 100 and/or a nearby boat, ship, or other vessel, or devices onboard such a boat, ship, or other vessel or on land or in the air. Pressing button 140 to activate the activation element may alert other divers and the devices/passengers of a nearby boat of danger and/or the need for assistance. Additionally, if passengers on a nearby boat identify a threat not known to the divers, passengers on the boat may activate the activation element on the communicatively coupled dive masks 100 to alert the divers. For example, when the activation element is activated by a passenger on a boat, the at least one LED 139 may illuminate a specific color associated with the boat, signaling the divers to end the dive. Conversely, if diver(s) using dive mask 100 detects danger, they may activate the activation element to alert companions on a nearby boat, ship, the Coast Guard, or other emergency services of danger. In embodiments, the activation element may include a severe danger notification that immediately notifies emergency services to send assistance. In embodiments, the activation element may communicate with a mobile application or website communicatively coupled with dive mask 100 to receive alerts from the activation element.

In some embodiments, the alert subsystem 150 of dive mask 100 may be communicatively coupled to a weather report service. For example, alert subsystem 150 may detect information from a weather report service if a storm or other dangerous weather is approaching and activate the activation element on the dive mask 100 to alert the diver to end the dive. When the activation element is activated by alert subsystem 150 due to dangerous weather, the at least one LED 139 may illuminate a specific color associated with bad weather to notify the diver of the impending weather.

In some embodiments, dive mask 100 may have several levels of the activation element. For example, one press of button 140 may indicate serious and immediate danger, while two presses of button 140 may indicate mild danger or needing to proceed with caution. The activation element may be customized in this manner using a mobile application or website associated with dive mask 100.

Figure 10:
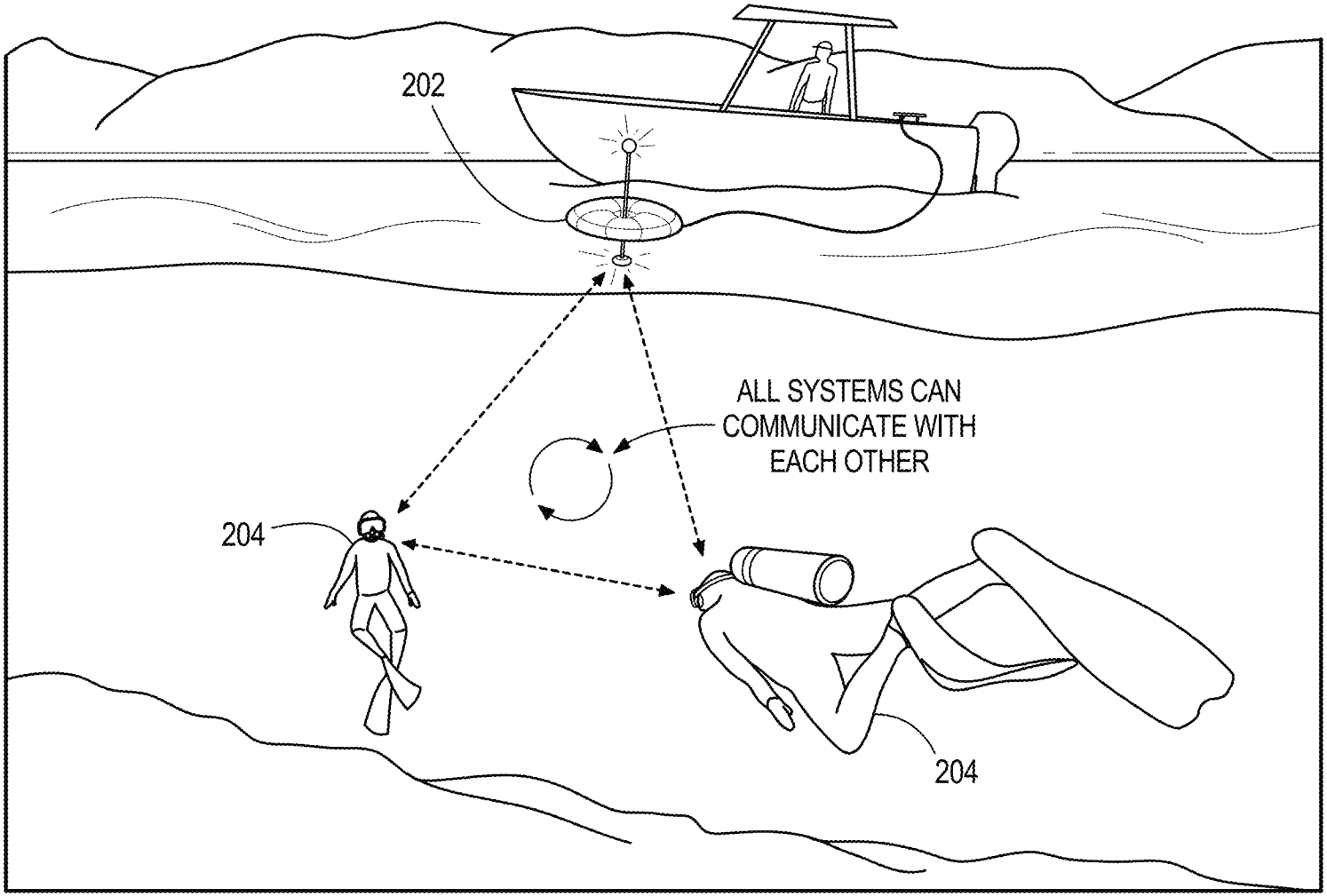
FIG. 10 is a schematic of a dive mask in communication with a floating beacon, in accordance with an embodiment of the disclosure.

With additional reference to FIG. 10, in some embodiments, the activation element may communicate with floating beacon 202. Floating beacon 202 may be a buoy or other device capable of floating in water and comprises an ultrasonic communication system (not shown) communicatively coupled to one or more dive masks 100 and/or to a nearby ship or boat. The ultrasonic communication system on floating beacon 202 comprises an ultrasonic sensor (not shown) capable of receiving information from a dive mask 100.

In use, a diver (or divers) 204 using dive mask 100 may activate the activation element as described in this disclosure, and the ultrasonic communication system 160 will communicate with floating beacon 202. Once the activation element has communicated with floating beacon 202, floating beacon 202 may emit a sound or illuminate a light to notify a nearby boat or ship that diver 204 has activated the activation element. This may notify those on the ship or boat that diver 204 is experiencing or may be experiencing danger or distress, or that the same may be imminent. Conversely, those on the boat or ship may activate the floating beacon 202 to illuminate the at least one LED 139 on the dive mask 100 to notify diver 204 of danger, such as an impending storm or dangerous wildlife.

Figure 11A:
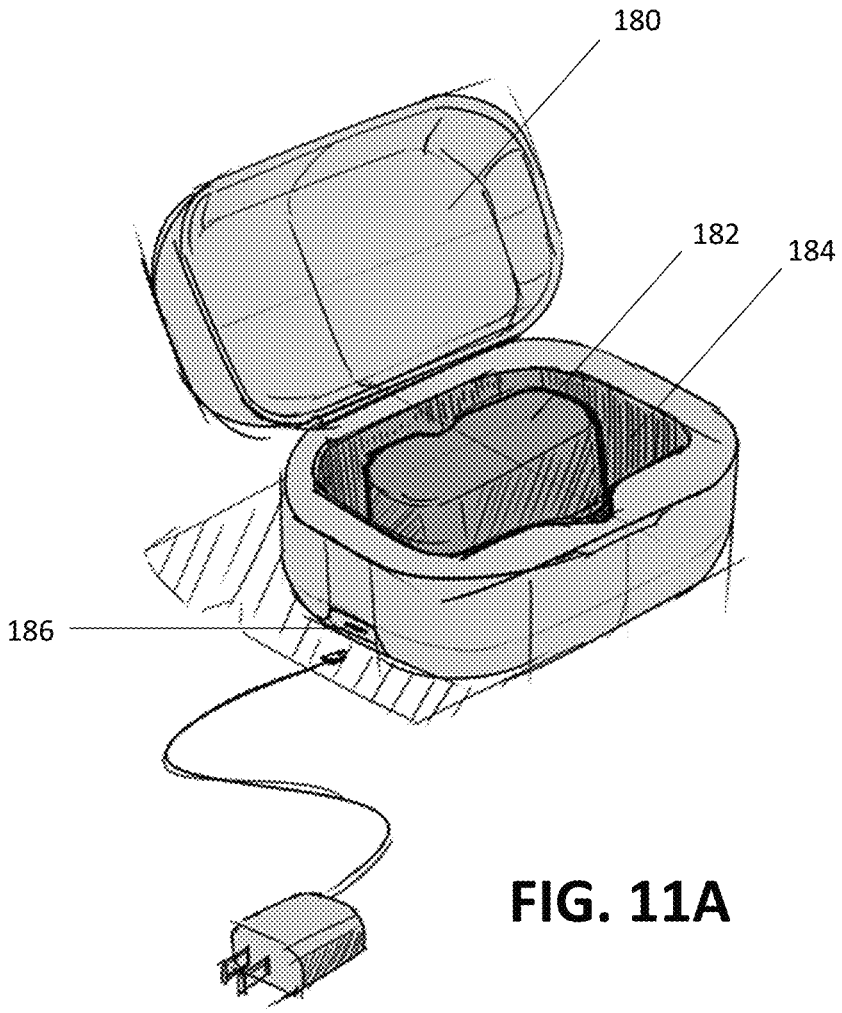
FIG. 11A is a carrying case for use with a dive mask, in accordance with an embodiment of the disclosure.
Figure 11B:
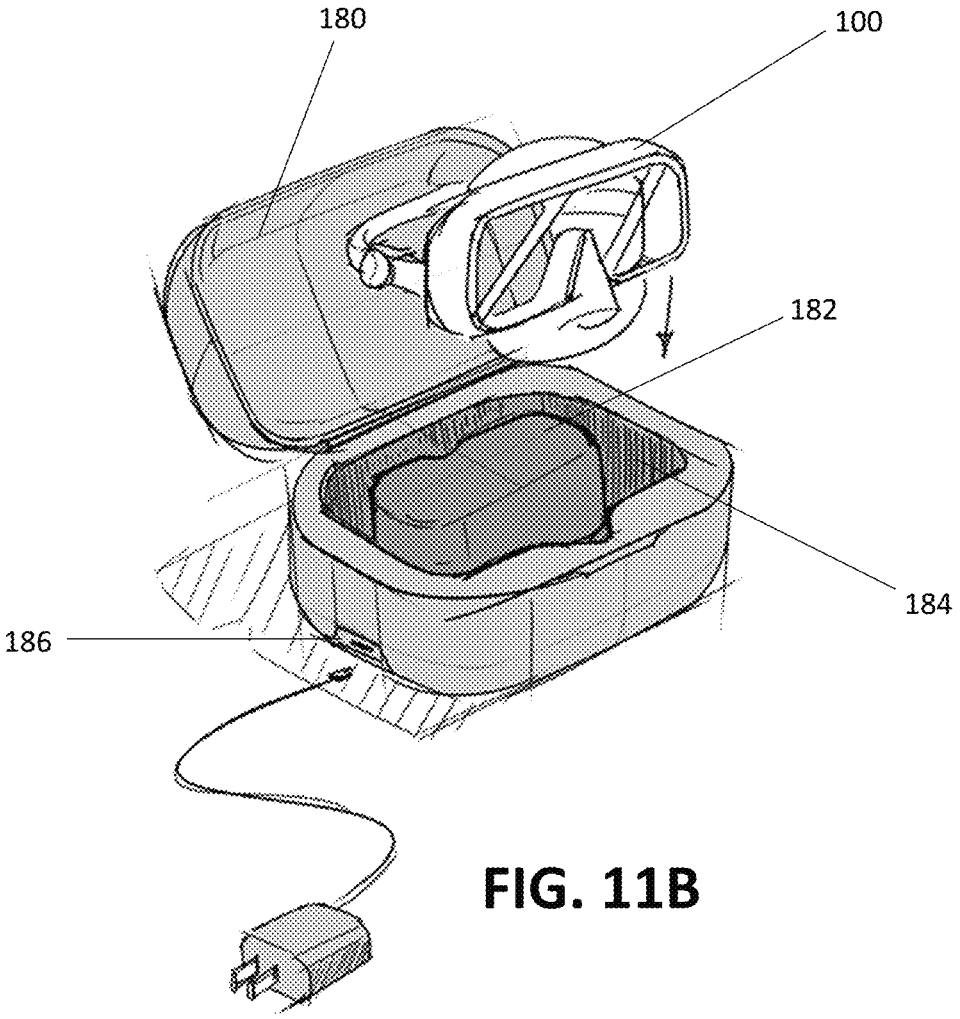
FIG. 11B is a carrying case with a dive mask, in accordance with an embodiment of the disclosure.

With reference to FIGS. 11A and 11B, a carrying case 180 for dive mask 100 may include charging capabilities known in the art. Carrying case 180 includes a docking station 182 configured to hold dive mask 100 within inner cavity 184 for charging. In embodiments, carrying case 180 may include wireless charging capabilities in docking station 182, inner cavity 184, and/or in the inner walls of carrying case 180. Carrying case 180 itself may be charged using charging port 186 connected to a power source. Carrying case 180 is configured to hold charging capacity that may be used to charge dive mask 100 even while charging case 180 is not connected to a power source. Carrying case 180 may be communicatively coupled to a mobile application or website associated with dive mask 100 configured to notify a user of the charge level and charging status of the dive mask 100 and the carrying case 180.

In some circumstances, divers may neglect to fully charge the dive mask 100 or second dive mask 100 before diving and may experience low power capacity of the battery of one or multiple dive masks 100 during a dive. This may be dangerous for divers who are relying on the dive mask 100 to alert them if they exceed the setpoint range 170 or need to alert their diving partner of any danger. In an embodiment, if the charge level of battery 136 of either dive mask 100 or second dive mask 100 is below a certain charge level, battery 136 in each dive mask 100 will communicate with the alert subsystem 150 to trigger a low battery warning to illuminate the at least one LED 139 in the illuminating edge 138 of dive mask 100 and second dive mask 100. The at least one LED 139 may be illuminated in a color and light pattern different from the distance or danger functions. For example, if the level of battery 136 falls below 10%, the at least one LED 139 may be illuminated with white light that will rapidly blink twice every 3 seconds. Divers may decide whether to continue the dive or to return to the surface and end the dive. If the divers wish to end the dive at this point, they may return to the surface and turn off dive mask 100 and second dive mask 100 by pressing and holding button 140 for several seconds. If the divers wish to continue the dive without the use of dive mask 100 and second dive mask 100, they may press and hold button 140 for several seconds while underwater to turn off dive mask 100 and second dive mask 100. The divers are then aware they are continuing the dive without the use of the functionalities of either dive mask 100.

If the level of battery 136 falls below, for example, 10% and the divers wish to prolong the dive for a short period of time, they may do nothing and continue the dive, and the at least one LED 139 will continue to illuminate and blink. If the level of the battery falls below a lower threshold value (for example, 5%), the at least one LED 139 may illuminate and blink more rapidly and frequently to signal to the divers that the battery 136 in one of both of dive mask 100 or second dive mask 100 is close to running out of power. The divers may decide whether to continue the dive without either dive mask 100 or to end the dive. The at least one LED 139 will continue to illuminate and blink until the level in battery 136 in either dive mask 100 or second dive mask 100 reaches empty and then turn off, signaling to the divers that the dive mask 100 and second dive mask 100 are no longer communicating.

Other combinations of battery percentages and illumination are contemplated. For example, divers may wish to be notified when the level of their battery 136 falls below a higher threshold, such as 20%, for dives that are deeper or farther away from their boat. Additionally, divers may wish to adjust the color, interval, or frequency of the illumination or blinking of the at least one LED 139. Such parameters may be selected by a user using a mobile application or website associated with dive mask 100.

In some embodiments, dive mask 100 may include additional features such as haptic or auditory alerts. For example, dive mask 100 may vibrate or make a sound to notify a diver they are outside the setpoint range 170 or when the activation element is activated by pressing button 140. Haptic or auditory alerts may be selected enabled or disabled by a diver. Some divers may dislike haptic and auditory alerts interfering with their diving experience and wish to disable them, while others may prefer haptic or auditory alerts to enhance communication between divers. In some situations, haptic or auditory alerts may be disfavored to avoid attracting unwanted ocean animals that may be drawn to specific sounds or vibrations, which may depend on the location, time, or season of the dive. Divers may enable or disable haptic or auditory alerts using a mobile application or website associated with dive mask 100, or using button 140 on dive mask 100. For example, a diver may enable or disable these alerts by pressing and holding button 140 for 5 seconds. Other configurations to enable or disable the alerts are contemplated, such as multiple presses of button 140, pressing and holding button 140 for longer periods of time, a switch, a second button, or an additional setting on knob 142.

Dive mask 100 in accordance with this disclosure has several advantages. The at least one LED 139 in illuminating edge 138 or indicator light 139*a* provides a non-intrusive method of notifying a diver they have exceeded a setpoint range 170 from their diving partner(s) or the activation element has been activated. When the at least one LED 139 is illuminated, the light is visible to the diver around the periphery of the lens 130 without obstructing the diver's line of sight. In some embodiments, illuminating edge 138 or indicator light 139*a* is configured so the illuminated at least one LED 139 is visible only to the diver in the lens 130 but not visible from the front of the mask to prevent light from aggravating or disturbing ocean animals or other sea life. In some embodiments, the at least one LED 139 may be dimmable or the tone of the colors may be adjusted. The at least one LED 139 may appear too bright to a diver in some situations, for example, if a diver is diving inside of a shipwreck or in dark waters, a diver may wish to dim the at least one LED 139 or adjust the tone of the color.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

What is claimed is:

1. An underwater communication system comprising:

A first underwater transceiver coupled to a first dive mask wearable by a user and comprising:

A user input manipulatable to define a setpoint range,

At least one light-emitting diode (LED), and an ultrasonic communication system configured to communicate with the at least one LED to selectively illuminate the at least one LED and comprising:

An emitter configured to emit a first ultrasonic signal indicating a first location of the first dive mask, A receiver configured to receive a second ultrasonic signal indicating a second location of a second transceiver of a second dive mask, and A processor communicatively coupled to the ultrasonic communication system and configured to:

Determine a distance between the first location and the second location from at least one of the first ultrasonic signal or the second ultrasonic signal compare the distance to the setpoint range, and cause the ultrasonic communication system to selectively illuminate the at least one LED based upon a result of the comparing.

2. The underwater communication system of claim 1, wherein the first underwater transceiver further comprises an activation element configured to indicate distress or danger at the second transceiver upon activation of the activation element.

3. The underwater communication system of claim 2, wherein the activation element comprises a button or a switch.

4. The underwater communication system of claim 2, wherein the second transceiver is coupled to a second mask wearable by a second user, and activating the activation element causes at least one LED at the second mask to illuminate.

5. The underwater communication system of claim 2, wherein the second transceiver is couplable to a surface beacon device, and activating the activation element causes the surface beacon device to issue at alert.

6. The underwater communication system of claim 1, wherein the setpoint range is selected using a mobile application or a website communicatively coupled to the first underwater transceiver.

7. The underwater communication system of claim 6, wherein the setpoint range is selected from a range of about 1.5 feet to about 30 feet.

8. The underwater communication system of claim 1, wherein causing the ultrasonic communication system to activate the at least one LED further comprises activating the at least one LED according to a first level alert, a second level alert, or a third level alert.

9. The underwater communication system of claim 8, wherein the first level alert, the second level alert, and the third level alert each comprise a different one of at least one of the following: a color of the at least one LED or an illumination pattern of the at least one LED.

10. The underwater communication system of claim 1, wherein the first underwater transceiver further comprises a battery that is rechargeable or replaceable.

11. The underwater communication system of claim 10, further comprising a charging case that has wired or wireless charging capabilities.

12. The underwater communication system of claim 10, wherein the processor is configured to issue a low battery warning when the power capacity of a battery falls below a specified level.

13. The underwater communication system of claim 12, wherein the low battery warning illuminates the at least one LED.

14. The underwater communication system of claim 13, wherein the at least one LED is illuminated by at least one of pulsing or changing colors.

15. The underwater communication system of claim 1, wherein the dive communication system is communicatively coupled to a weather report service, and the at least one LED can be selectively illuminated based on information received from the weather report service.

16. The underwater communication system of claim 1, wherein the second transceiver comprises:

A second user input manipulatable to define a second setpoint range,

At least one second LED, and

A second ultrasonic communication system configured to communicate with the at least one second LED to selectively illuminate the at least one second LED and comprising:

A second emitter configured to emit a second ultrasonic signal indicating the second location of the second dive mask, A second receiver configured to receive the first signal indicating the first location of the first dive mask, and a second processor communicatively coupled to the second ultrasonic communication system and configured to:

Determine a second distance between the first location and the second location, compare the second distance to the second setpoint range, and cause the second ultrasonic communication system to selectively illuminate the at least one second LED based upon a result of the comparing.

17. The underwater communication system of claim 1, further comprising a surface beacon device, wherein the surface beacon device comprises the second transceiver.

18. The underwater communication system of claim 17, wherein the surface beacon device is a floatable buoy.

19. The underwater communication system of claim 18, wherein the second transceiver is removably couplable with the floatable buoy.

20. The underwater communication system of claim 1, wherein the first underwater transceiver further comprises at least one of a haptic alert system or an auditory alert system, and wherein the ultrasonic communication system is configured to communicate with the at least one of the haptic alert system or the auditory alert system to cause the at least one of the haptic alert system or the auditory alert system to activate based on a result of the comparing.

21. The underwater communication system of claim 1, further comprising an additional LED communicatively coupled with the processor.

22. The underwater communication system of claim 16, further comprising a surface beacon device configured to communicate with the first underwater transceiver and the second transceiver.

23. The underwater communication system of claim 17, wherein the surface beacon device is a floatable buoy.

* * * * *